United States Patent [19]

Csizy et al.

[11] 4,204,184

[45] May 20, 1980

[54] FUSE-ELEMENT FOR ELECTRIC FUSES

[75] Inventors: Tibor Csizy; Árpád Kárpát; Janós Melis; Zoltan Szemerey, all of Budapest, Hungary

[73] Assignee: Villamos Berendezés és Készüvék Müvek, Budapest, Hungary

[21] Appl. No.: 894,837

[22] Filed: Apr. 10, 1978

Related U.S. Application Data

[63] Continuation of Ser. No. 687,542, May 18, 1976, abandoned.

[30] Foreign Application Priority Data

May 19, 1975 [HU] Hungary ..... VI 1044

[51] Int. Cl.[2] ..... H01H 85/10

[52] U.S. Cl. ..... 337/295; 337/159

[58] Field of Search ..... 337/295, 296, 292, 290, 337/158, 159, 160, 161, 162, 166

[56] References Cited

U.S. PATENT DOCUMENTS

| | | | |
|---|---|---|---|
| 3,116,390 | 12/1963 | Goody et al. | 337/296 |
| 4,101,860 | 7/1978 | Fister | 337/159 |

*Primary Examiner*—Harold Broome

*Attorney, Agent, or Firm*—Ernest F. Marmorek

[57] ABSTRACT

A fuse-element for electric fuses is shaped as a metal strip with one or more zones of diminished cross-section.

The temperature rise conditions of the fuse-element and of its zones of diminished cross-section can be established and evaluated in combination and—based on these data—a fuse-element can be designed the temperature distribution characteristics of which include different local peak values and the spots where such peak values develop can be set in a manner that the whole fuse-element consists of two parts as far as the temperature distribution is concerned, i.e. a first part where this distribution is in accordance with a steady state distribution (the highest current value still failing to cause any melting), and a second part where the temperature rise distribution determines the character of the melting process, this being the so-called transient distribution characteristic. Such a design facilitates an essentially more exact setting of the rated currents and the desired melting time/current characteristics.

The solution of this task, according to the invention, consists in that at least one of the zones of diminished cross-section, extending longitudinally along a part of the metal strip at which the operating temperature reaches relatively small values, is of a smaller cross-section than the remaining zones and exceeds the latter ones in length. The smallest cross-section is preferably arranged as a marginal zone, i.e. the zone is disposed next to one end of the fuse-element.

12 Claims, 8 Drawing Figures

FUSE-ELEMENT FOR ELECTRIC FUSES

This is a continuation of application Ser. No. 687,542, filed May 18, 1976, now abandoned.

BACKGROUND OF THE INVENTION

The invention relates to a fuse-element for electric fuses that is shaped as a metal strip with one or more zones of diminished cross-section.

It is a well-known tendency in this field to develop special types of electric fuses with different time/current characteristics chosen in a manner as to enable them to provide for different kinds of protection. In this way, time/current characteristics have been developed referred to as "inert", "quick", "superquick", and "inert-quick". It is a common requirement for all fuses—be they of any of the specified types—that they shall perform the breaking operation extremely quickly and at a high reliability, if a short-circuit current of high value appears. The continuous extension of the electric energy distribution systems and the increasing value of the distribution voltage led to the value of the desired breaking capacity also being continuously increased. Nowadays it is required that an up-to-date type fuse shall perform the breaking of a 100 kA short-circuit current at a supply voltage of 660 V at a high reliability.

It is a special problem to obtain a suitable shape of the lower section of the time/current characteristic, i.e. the part of it including the small current values. In the prior art, different methods are known to solve this problem. FIGS. 1–3 show three different variants of known fuse-elements 1, 2 and 3. A common feature of them is that zones of diminished cross-section are shaped in the central part of the elements, but the zones are made in different ways. The zones determine the spot where the elements will fuse first in the case of a high overload or short-circuit, and at the same time this is the spot where an arc will arise.

A further common feature of the fuse-elements is that a metal or metal alloy 4 of low melting temperature is applied onto the fuse-element. In case of a small overload, the metal or metal alloy will melt, and in its melted state diffuse into the metal strip increasing its resistance, causing local heating and time-dependent melting. FIGS. 4 and 5 show a fuse-element 5 that is cut in its midst to two pieces, the pieces being connected to each other by an arc-like bent sheet 7 made of the same material as the fuse-element; the connection is established along the edges by the weld 8. Currents of high value cause a melting in the diminished cross-section 6, whereas a smaller overload causes the melting of the weld 8 at the spot of highest temperature where the arc will arise. Sheet 7 serves as heat dissipater delaying the temperature rise.

Curve 10 of FIG. 6 shows the temperature distribution along the fuse-elements 1, 2, and 3 that can be measured inside the casing of the fuse at the highest current value that still fails to result in melting. This curve is characteristic for the steady state during work. At the spot where the diminished—smallest—cross-section is shaped, a slightly higher temperature can be measured (see curve 10) than the one appearing if the cross-section is not diminished (see curve 11). The increase of temperature is only slight, because the conduction of heat is good enough to dissipate the heat arising very quickly, so that only a small temperature difference can develop. In a transient state, however, caused by a short-circuit current of high value, a sudden temperature rise as shown in curve 12, will develop at the smallest cross-section. If this temperature peak value exceeds the melting point of the fuse-element, the element fuses.

In the diminished cross-section a steady state can only occur if the arising heat quantity, being proportional to the square of the current, can proceed in time towards the greater dissipating surfaces. The speed of this heat transmission depends on the temperature difference causing it but it is essential that this difference be of a nature so as not to allow the highest temperature value even to approach the melting point. Conditions are also influenced by the fact that the resistance of the fuse-element increases with temperature. Thus, the value R in the formula $I^2.R$ becomes also a current dependent quantity. It is characteristic for the transient state i.e. in a state when the thermal equilibrum is already upset, that the increase of heat production (a function of the square of the current) is steeper than the increase of heat dissipation (rising according to a linear function). Once the thermal equilibrum is upset, that part of the heat that cannot be dissipated accumulates rapidly, and a very quick temperature rise develops that will finally exceed the melting point and cause the breaking of the fuse.

There is a standard requirement specifying the ratio between the maximum current still failing to cause any melting, and the rated operating current of a given fuse-link. Most of the customers require that a fuse shall, while meeting this requirement, also blow very quickly in the case of a relatively small overload. Generally, the standard regulations prevent the melting of a fuse element during a period of 1 to 3 hours if the current does not exceed 1.3 times its rated value, $1.3 \times I_{rated}$ being the lower threshold of the overload range.

In public networks, the standard requirements concerning protection against electric shock can be met more easily, if quickly melting fuses and not inert fuses are used. The melting time of inert fuses is very long and, in the case of long lines of high impedance, the aforesaid standard safety requirements can only be met, if the inert fuse is of a rated current lower than the thermal load limit, i.e. the network cannot be fully made use of. Usually, electricity generating plants allow a maximum melting time of 5 seconds, if the current is two times its rated value. Even quick fuses according to prior art are not apt to meet the 5 second melting requirement if the current is lower than $3 \times I_{rated}$; other types of fuses perform this duty only if the current exceeds 4–5 times the rated current. It can be seen that a breaking within 5 seconds in the case of an earth leaking current is only possible, if the rated current of the fuse is lower than the load allowed in the given network. And if the fuse is intended to protect a semiconductor, it is due to the excessively long melting time of the fuse that semiconductors must be used, the rated current of which amounts to two or three times the value of the rated current of the equipment they are used in, and consequently such semiconductors are also much more expensive.

SUMMARY OF THE INVENTION

The present invention has been developed in order to find a solution devoid of the disadvantages set forth hereinbefore. It is the intent to create a fuse-element that fuses or blows within 5 seconds if the current is two times its rated value whereas it is designed to have a long life without any change in features if loaded according to its rated value.

The invention is based on the conception that the temperature rise conditions of the fuse-element and of its zones of diminished cross-section can be established and evaluated in combination, and that based on these data, a fuse-element can be designed the temperature distribution characteristics of which have different local peak values, and where the spots where such peak values develop can be set in a manner so that the whole fuse-element includes two parts as far as the temperature distribution is concerned, i.e. a first part where this distribution is in accordance with a corresponding steady state value (the highest current value still failing to cause any melting), and a second part where the temperature rise distribution is determining the character of the melting process, this being the so-called transient distribution characteristic, and that such a design facilitates an essentially more exact setting of the rated currents and the desired melting time/current characteristics.

The solution of this task, according to the present invention, consists in that at least one of the zones of diminished cross-section, extending longitudinally along a part of the metal strip at which the working temperature reaches relatively small values, is of a smaller cross-section than the other zones, and exceeds the latter zones in length. The zone of smallest cross-section is preferably arranged as a marginal zone, i.e. this zone is disposed next to one end of the fuse-element.

A further improvement of the temperature distribution along the fuse-element can be obtained by applying a metal or metal alloy to the ends of the zone of smallest cross-section, the metal or metal alloy having of a predetermined heat capacity and a melting point lower than the melting point of the fuse-element.

In a preferred embodiment of the invention the ratio of the geometrical features is the following:

$$L_{min}=2\times L_{dim}$$

and $$Q_{min}=0.5\times Q_{dim}$$

where $L_{min}$ = the length of the zone of smallest cross-section $L_{dim}$ = the length of the remaining zones of diminished cross-section $Q_{min}$ = the cross-section of the zone of smallest cross-section $Q_{dim}$ = the cross-section of the remaining zones of diminished cross-section It is an advantage of the fuse-element according to the present invention that the influence of the highest current causing still failing to cause any melting and the influence of the transient currents causing melting are nearly independent of each other, so that an exact setting of advantageous time/current characteristics for the fuse-elements becomes possible.

BRIEF DESCRIPTION OF THE DRAWING

The invention will now be described more particularly with reference to the accompanying drawings.

DESCRIPTION OF THE PREFERRED EMBODIMENTS

The diminution of the cross-section in the fuse-element according to the present invention, is performed by establishing short zones consisting of a plurality of parallel rods of small cross-section, so-called bridges. This way the cooling conditions are improved to an extent that the temperature distribution along the zones differs only slightly from the temperature distribution prevailing in the parts of continuous cross-section to the current not exceeding the highest value failing to cause a melting of the fuse.

But in one of the zones the geometry of the bridge is different from the remaining zones, i.e. the cross-section of the bridge is relatively small, whereas its length is greater. The transfer of the heat arising at the bridge is dependent on the geometry of the bridge.

It is obvious that the same current will produce more heat if the bridge is longer and of a smaller cross-section so that the thermal resistance is increased, so that the temperature difference along the bridge will also be higher. Such a bridge will also be more sensitive to transient currents.

The transient currents can be classified as far as their influence on the fuse-element is concerned. In the range of a relatively small overload the said bridge of greater resistance and higher sensitivity plays a decisive role, the temperature rise in this bridge determining the operation of the fuse-element. In the short-circuit current range the thermal equilibrium of all bridges will be upset at about the same time.

Figure 1:
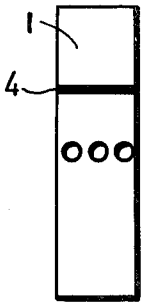
FIG. 1 PRIOR ART
FIGS. 1 through 5 show different fuse-elements of the prior art.
Figure 2:
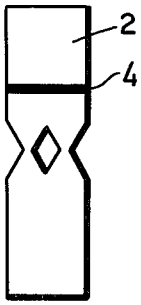
FIG. 2 PRIOR ART
Figure 3:
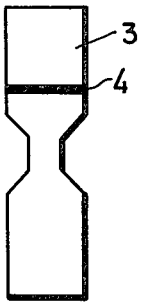
FIG. 3 PRIOR ART
Figure 4:
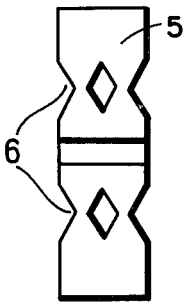
FIG. 4 PRIOR ART
Figure 5:
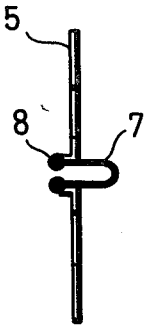
FIG. 5 PRIOR ART
Figure 6:
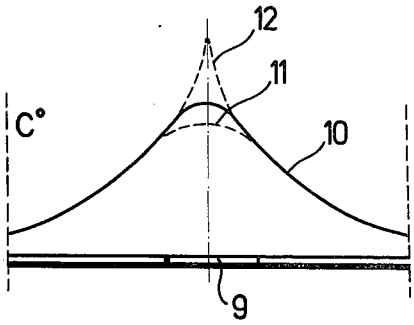
FIG. 6 PRIOR ART
FIG. 6 shows the temperature distribution of known fuse-elements.
Figure 7:
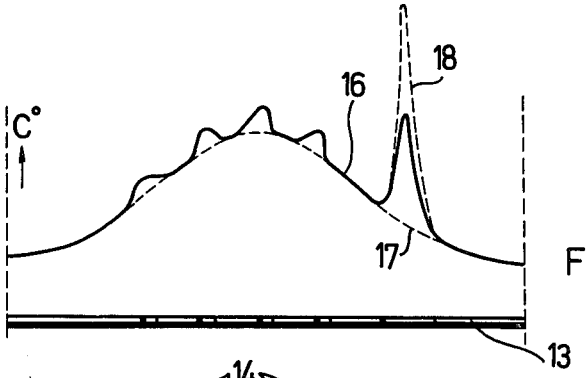
FIG. 7 shows the temperature distribution curve of a fuse element, according to the present invention.
Figure 8:
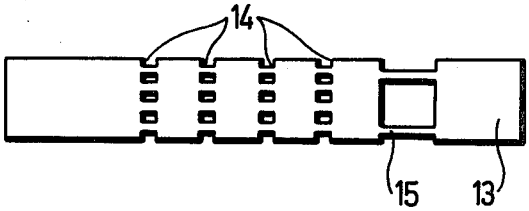
FIG. 8 shows the construction of a fuse-element according to the present invention.

A preferred embodiment of the fuse-element according to the present invention can be seen at FIG. 8, the temperature conditions prevailing there being shown in the FIG. 7. The fuse-element 13 comprises short bridges 14 and a bridge 15 of higher resistance. The bridge 15 has a cross-section equal to about one half of the cross-section of each of the bridges 14, whereas its length is about twice that of the bridges 14. Its resistance is therefore in a cold state about four times that of the bridges 14, and it increases during operation more quickly since its temperature rises also more quickly, thus increasing its operative resistance, compared to its resistance in the cold state. In the state of steady thermal equilibrium, i.e. at the highest current still failing to cause any melting, the difference between the resistances of bridge 15 and the bridges 14 will therefore be much greater. The temperature rise conditions can be seen from graph 16. At the bridges 14 only a slight temperature rise can be measured, whereas the thermal equilibrium of bridge 15 can only develop at a much more higher temperature. According to the invention, this bridge 15 is required to be disposed at a location where the temperature rise curve 17 of the fuse-element 13 has relatively low values but the distance and portion 15 from the end of one fuse-element 13 is required to be at least 20–25% of the whole length of the fuse-element 13 in order to avoid any disturbing influence of the ambient temperature on the bridge 15. The thermal equilibrium of the bridge 15 is established at a point already close to the steady state equilibrium so that a relatively small increase of current can cause the heat dissipation to be considerably less than the heat generation at the bridge 15. This process causes a temperature peak 18 so that the fuse-link 15, and therefore the whole fuse element 13 is blown. The arrangement, according to the present invention makes it possible to bring the value of the highest current still failing to cause any melting, and the value of the smallest overload already causing quick melting closer to each other. Thus, the requirements of both the electricity generating plant and those of the customer are satisfied.

The short-circuit currents of high value cause the upset of the thermal equilibrium at both the bridge 15 and the bridge 14 at the same time and the short-circuit arc is present at all bridges. It is an advantage of this multiple arc that channels of quartz melt are developing simultaneously at all bridges limiting the current and increasing the intensity of arc extinction since the threshold voltage under which any arc is extinguished is also increased thereby many times. This way it is possible for a 500 V fuse to operate at its rated current breaking capacity even at 660 V, without the need of any change in dimensions.

The temperature rise conditions of the bridge 15 and, thus, its operation in the transient range can be set within a wide range by applying at the end of the bridge, i.e. at the spot where the bridge is connected to the part of higher cooling performance of the fuse-element, either a metal of predetermined heat capacity such as silver, or a suitable metal alloy, or maybe a glass bead. The heating and melting of the metal or metal alloy causes a delay in the temperature rise of the bridge and in this way the melting time/current characteristics of the bridge can practically be set by will.

What we claim is:

1. A fuse element of an electric fuse for protecting a circuit comprising in combination:

a first portion having at least a first zone of reduced cross-section and predetermined length for being blown in response to a severe overload of relatively short duration, and a second portion connected in series with said first portion and having a second zone of reduced cross-section and predetermined length for being blown in response to a moderate overload of relatively long duration, each of said portions being composed of a predetermined and substantially identical metal, the cross-section of said second zone being smaller, and its length longer than the corresponding cross-section and length of said first zone, respectively, whereby the protected circuit will be disconnected from a power supply through said first and second portions in response to said relatively short and severe, and said relatively long, and moderate overloads, respectively.

2. A fuse element according to claim 1, wherein each of said portions is composed of metal and has a longitudinal shape.

3. A fuse element according to claim 2, wherein said portions are integrally connected to one another.

4. A fuse element according to claim 3, wherein the fuse element has two ends, said second zone being disposed in the vicinity of one of said ends.

5. A fuse element according to claim 1, further comprising a heat sink disposed in said second zone.

6. A fuse element according to claim 5, wherein said heat sink is composed of a metal, or a metal alloy.

7. A fuse element according to claim 5, wherein said heat sink is composed of glass.

8. A fuse element according to claim 5, wherein the cross-section of said second zone is about one half the cross-section of said first zone and about twice its length.

9. A fuse element according to claim 3, wherein the fuse element has two ends and a predetermined length, and wherein any part of said second zone is disposed at a distance from one of said ends equal to at least 20% of the predetermined length of the fuse element, so as to minimize the influence of ambient temperature on said second zone.

10. A fuse element according to claim 1, wherein the duration of said relatively short and severe overload is about 5 seconds.

11. A fuse element of an electric fuse for protecting a circuit comprising in combination:

a first portion having at least a first zone of reduced cross-section and predetermined length for being blown in response to a severe overload of relatively short duration, and a second portion connected in series with said first portion and having a second zone of reduced cross-section and predetermined length for being blown in response to a moderate overload of relatively long duration, each of said portions being composed of a predetermined and substantially identical metal, and having a longitudinal shape, the operative temperature of said second zone being relatively low compared to the operative temperature of said first zone, the cross-section of said second zone being smaller, and its length longer than the corresponding cross-section and length of said first zone, respectively, whereby the protected circuit will be disconnected from a power supply through said first and second portions in response to said relatively short and severe, and said relatively long, and moderate overloads, respectively.

12. A fuse strip, having two opposite ends, of an electric fuse for protecting a circuit comprising in combination:

a first portion having at least a first zone of reduced cross-section and predetermined length for being blown in response to a severe overload, and a second portion extending along a part of said strip near one of said ends, connected in series with said first portion and having a second zone of reduced cross-section and predetermined length for being blown in response to a moderate overload, each of said portions being composed of a predetermined and substantially identical metal, the cross-section of said second zone being smaller, and its length longer than the corresponding cross-section and length of said first zone, respectively, whereby the protected circuit will be disconnected from a power supply through said first and second portions in response to said moderate overloads, respectively.

* * * * *